United States Patent [19]

Hofer

[11] Patent Number: 5,005,710

[45] Date of Patent: Apr. 9, 1991

[54] RETAINING DEVICE

[76] Inventor: Karl Hofer, Emmentalstrasse 77, 3510 Konolfingen, Switzerland

[21] Appl. No.: 484,556

[22] Filed: Feb. 26, 1990

[30] Foreign Application Priority Data

Mar. 31, 1989 [CH] Switzerland ..... 1171/89

[51] Int. Cl.[5] ..... A47F 7/00

[52] U.S. Cl. ..... 211/70.6; 211/89; 206/373

[58] Field of Search ..... 211/70.6, 70.7, 70.8, 211/89, 60.1, 71, 120; 206/553, 373

[56] References Cited

U.S. PATENT DOCUMENTS

| | | | |
|---|---|---|---|
| 2,143,119 | 1/1939 | Waring . | |
| 2,591,805 | 4/1952 | Gossett . | |
| 2,774,481 | 12/1956 | Sievers et al. . | |
| 2,826,879 | 3/1958 | Evans . | |
| 2,899,077 | 8/1959 | Timms . | |
| 3,159,441 | 12/1964 | Sikma . | |
| 3,762,570 | 10/1973 | Tobin . | |
| 3,819,039 | 6/1974 | Erickson | 211/89 X |
| 3,842,980 | 10/1974 | Kushner . | |
| 3,946,877 | 3/1976 | Galicia | 211/89 X |
| 4,176,752 | 12/1979 | Taber | 211/89 X |
| 4,787,516 | 11/1988 | Morrison . | |

FOREIGN PATENT DOCUMENTS

| | | |
|---|---|---|
| 1260727 | 2/1968 | Fed. Rep. of Germany . |
| 1049697 | 12/1953 | France . |
| 1451468 | 7/1966 | France . |
| 3024414 | 1/1982 | Netherlands . |
| 3205035 | 8/1983 | Netherlands . |
| 8801022 | 5/1988 | Netherlands . |
| 171295 | 8/1934 | Switzerland . |
| 365940 | 1/1963 | Switzerland . |
| 2013161 | 8/1979 | United Kingdom . |
| 2116028 | 9/1983 | United Kingdom . |
| 2171080 | 8/1986 | United Kingdom . |

*Primary Examiner*—Sarah A. Lechok

*Attorney, Agent, or Firm*—Griffin Branigan & Butler

[57] ABSTRACT

A retaining device with a foam block 1 having incisions and a frame 2. On account of its flexibility the foam is able to receive various objects such as tools, appliances and other utensils and to keep these ready for use by means of adhesion. In addition, cables may be looped therein. It may also serve as a sales aid (display) and/or transport holder. It is simple to mount since it can have a self-adhesive mounting surface or be reinforced by a holder of metal, wood, plastic or another material which can be both applied by adhesion or screwed into place.

4 Claims, 4 Drawing Sheets

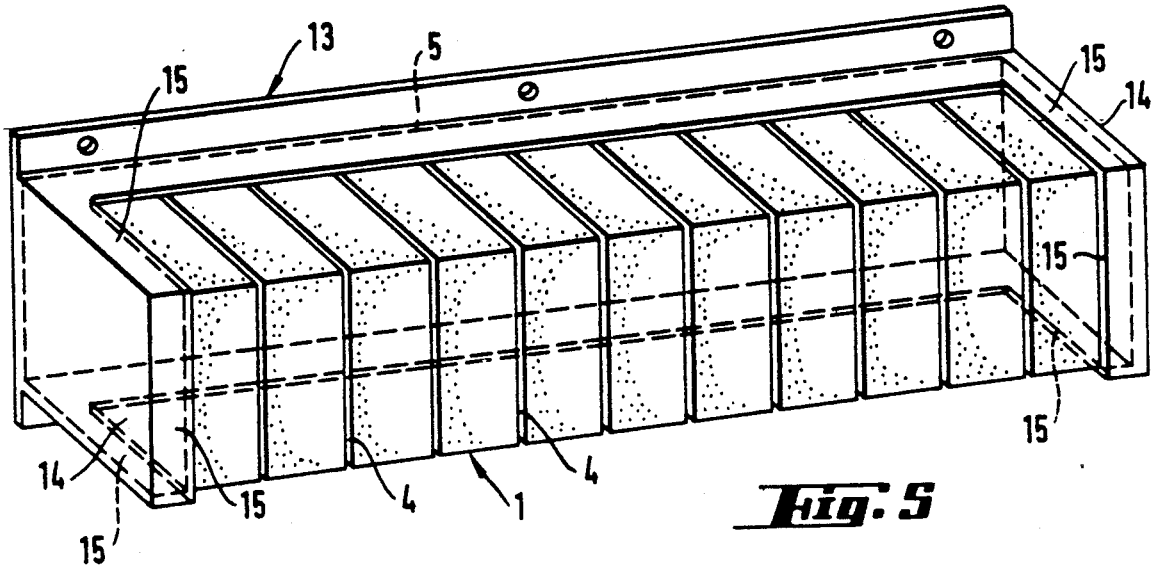
Fig. 5
Fig. 6
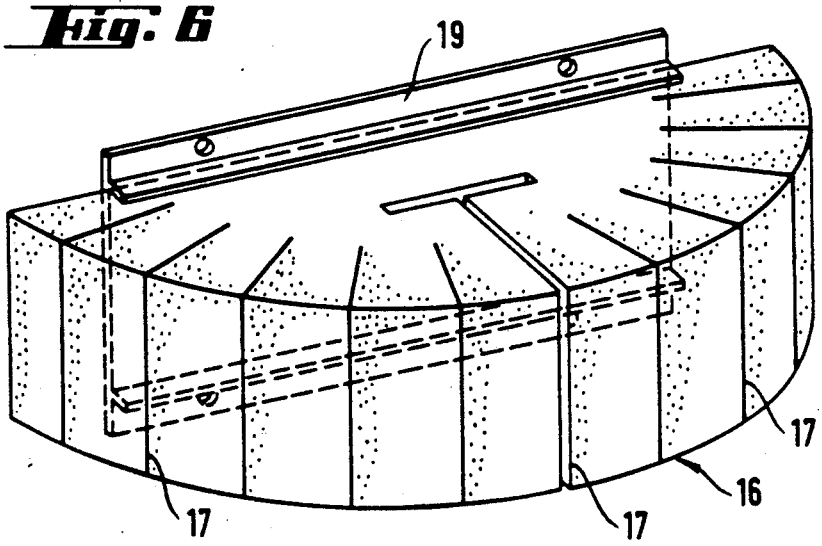

RETAINING DEVICE

FIELD OF THE INVENTION

The invention relates to a holder for the insertion and retention of preferably elongated objects of various thicknesses such as screwdrivers, knives, drills, scissors, brushes, writing implements, laboratory equipment, office requisites, various other products, appliances, toothbrushes, office requisites, household articles as well as cables, etc. disposed in a vertically standing or hanging configuration. The retaining device may also serve as a sales aid (display) and/or transport holder for various products.

DESCRIPTION OF THE PRIOR ART

Various holders are known for retaining appliances, stamps, etc. which are made of metal, wood, plastics or other materials. These can generally not be very universally used and can therefore only be employed for a relatively limited number of different kinds of appliances.

Holders are also known which are magnetized and which can only hold metal appliances.

Holders are also known which consist of a rubber grid into which for example garden tools with handles may be inserted and which are then retained by the rubber blocks. This type of retaining device is also more suitable for larger objects, such as garden tools and bears no resemblance to the present invention.

OBJECTS OF THE INVENTION

It is an object of the present invention to provide a retaining device which combines maximum flexibility as to the objects to be retained with the simplest possible manufacturing methods.

This object is achieved in accordance with the invention by means of a retaining device of the type described hereinabove

BRIEF DESCRIPTION OF THE INVENTION

According to the present invention therefore there is provided a retaining device for the insertion and retention of preferably elongated objects in vertically standing or hanging arrangement having a foam block having a plurality of incisions which are executed transversely from a side surface perpendicular to the elongated extension of the block beyond the center thereof in such a way that a continuous back comprising less than half of the block remains and a securing frame substantially surrounding the back.

The inserted objects are retained ready for use. Thanks to its natural resilience the foam readily adapts to various sizes and thickness of appliances and objects. The natural adhesion of the foam makes it possible to securely retain these appliances and objects. The foam provided with slits or incisions or holes can thus accommodate a relatively large number of different objects and appliances and thus makes it possible to maintain order and have the items clearly and tidily arranged. The retaining device may for example consist of polyurethane foam, PVC foam, polyethylene foam or foam rubber.

The foam block may also be provided with a self-adhesive surface and/or with a metal, wooden or plastic holder The foam block may have many different shapes, sizes and thicknesses, but is preferably square, rounded, semi-circular, circular or triangular. It may, however, also take the shape of animals and other motifs.

The foam block may have slits, incisions and/or holes, indentations, etc. so that it can receive and retain objects, tools, cables, writing implements, etc. of many different kinds.

The foam block may also be heat-stamped or sprayed with a coating material or paint or flocked so as it give it a more attractive appearance.

BRIEF DESCRIPTION OF THE DRAWINGS

A number of embodiments are shown hereinafter with reference to the appended drawings. There are shown in FIG. 1 a perspective view of a retaining device FIG. 2 an exploded view of part of the device of FIG. 1

FIG. 5 another alternative embodiment

FIG. 6 another alternative embodiment.

DETAILED DESCRIPTION OF THE INVENTION

Figure 1:
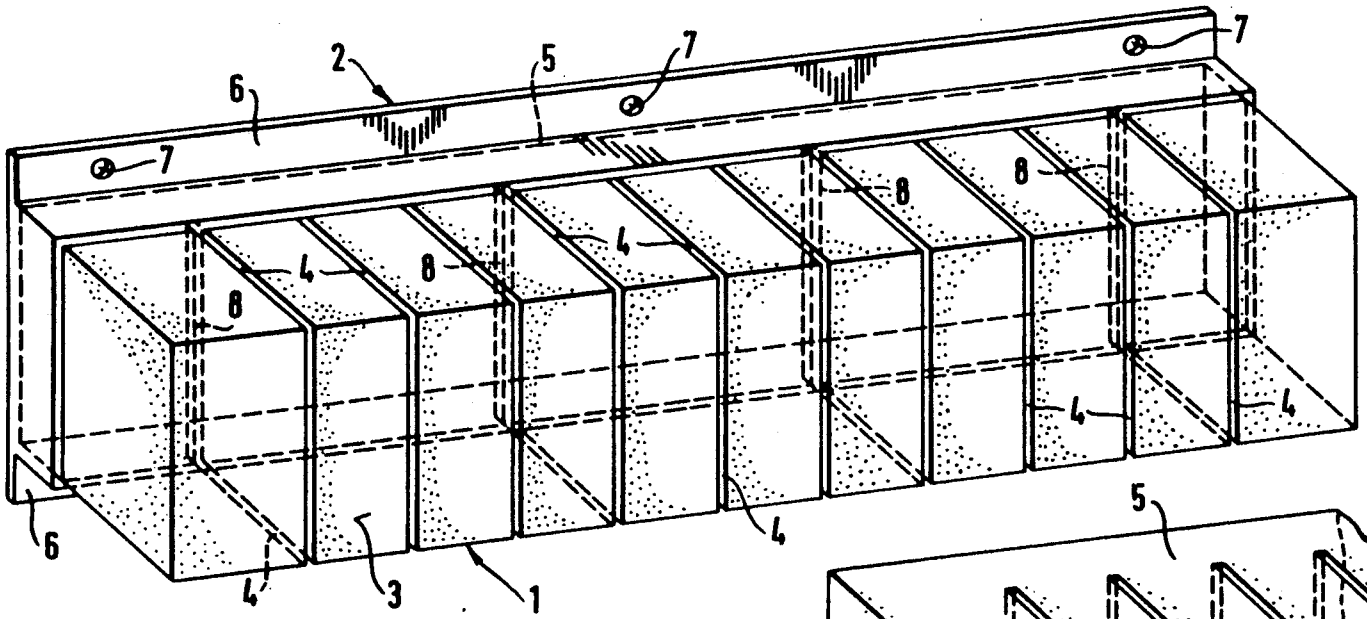
Figure 2:
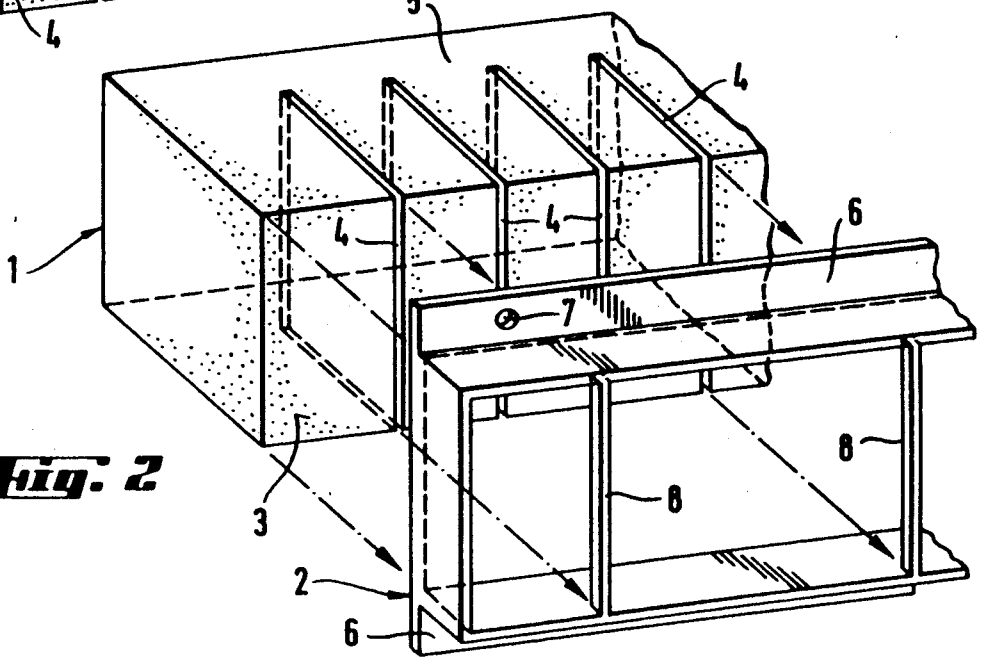

The retaining device shown in FIGS. 1 and 2 consists of a foam block 1 and a frame 2 which partially surrounds the block 1 and serves as holder for securing the device to a wall, etc. In the present example the foam block 1 has the shape of a rectangular parallelepiped. The block 1 has substantially parallel incisions commencing from the front side surface 3 at equal distances from one another, whereby the incisions 4 extend beyond the middle of the block, but only so far that a continuous back 5 remains.

The incisions 4 may if desired also be placed at irregular distances or diagonal to the front side surfaces The thickness of the remaining back is not critical and may be varied.

The frame 2 substantially surrounds the back 5 of the block 1 and has along its longer sides flat wider parts 6 with holes 7 for securing the device to a wall, etc. These flange-like wider parts may alternatively or in addition also be provided on the shorter small sides of the frame 2.

The frame has connecting bars 8 between the front edges of its longer sides at certain points corresponding to the positions of individual incisions. On assembling the foam block 1 and frame 2 into the entire device the block 1 is pushed from behind into the frame 2 in such a manner that the bars 8 impinge into the corresponding incisions. In the assembled state the bars prevent the block 1 from being pulled forwards out of the frame.

The foam block 1 consists in the present example of polyurethane foam, the frame of PVC.

Figure 3:
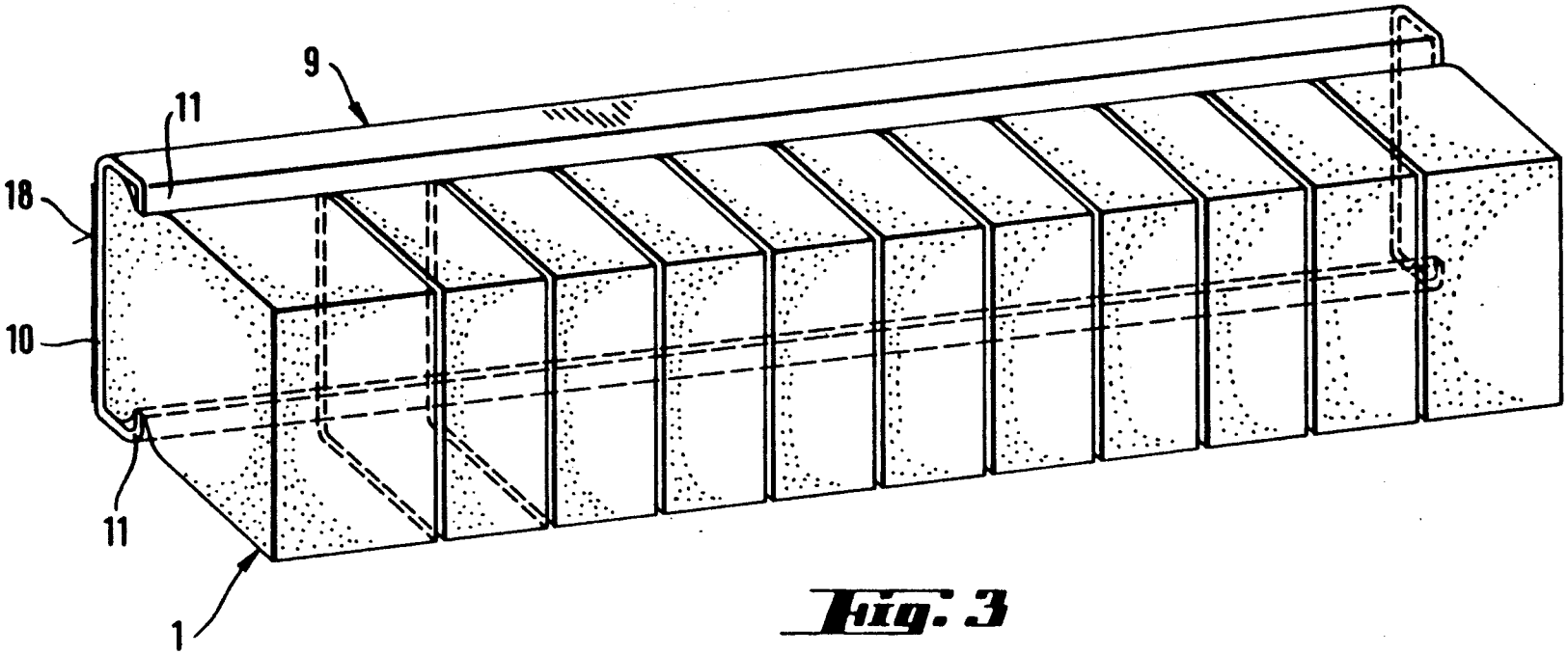
FIG. 3 a perspective view of an alternative form of retaining device

The embodiment shown in FIG. 3 differs from that described above in having a differently shaped frame 9. The foam block 1 is identical to that according to FIG. 1 or FIG. 2. The frame 9 consists of a plate 10 corresponding to the back of the block 1 with longer sides bent twice to surround the back 5 of the foam block 1 along its two longer edges. The bent parts 11 are formed in such a way that the back 5 is compressed and the block 1 is held in the frame in this manner. The back of the frame 9 is provided with an adhesive layer 18 for bonding to a supporting wall.

Figure 4:
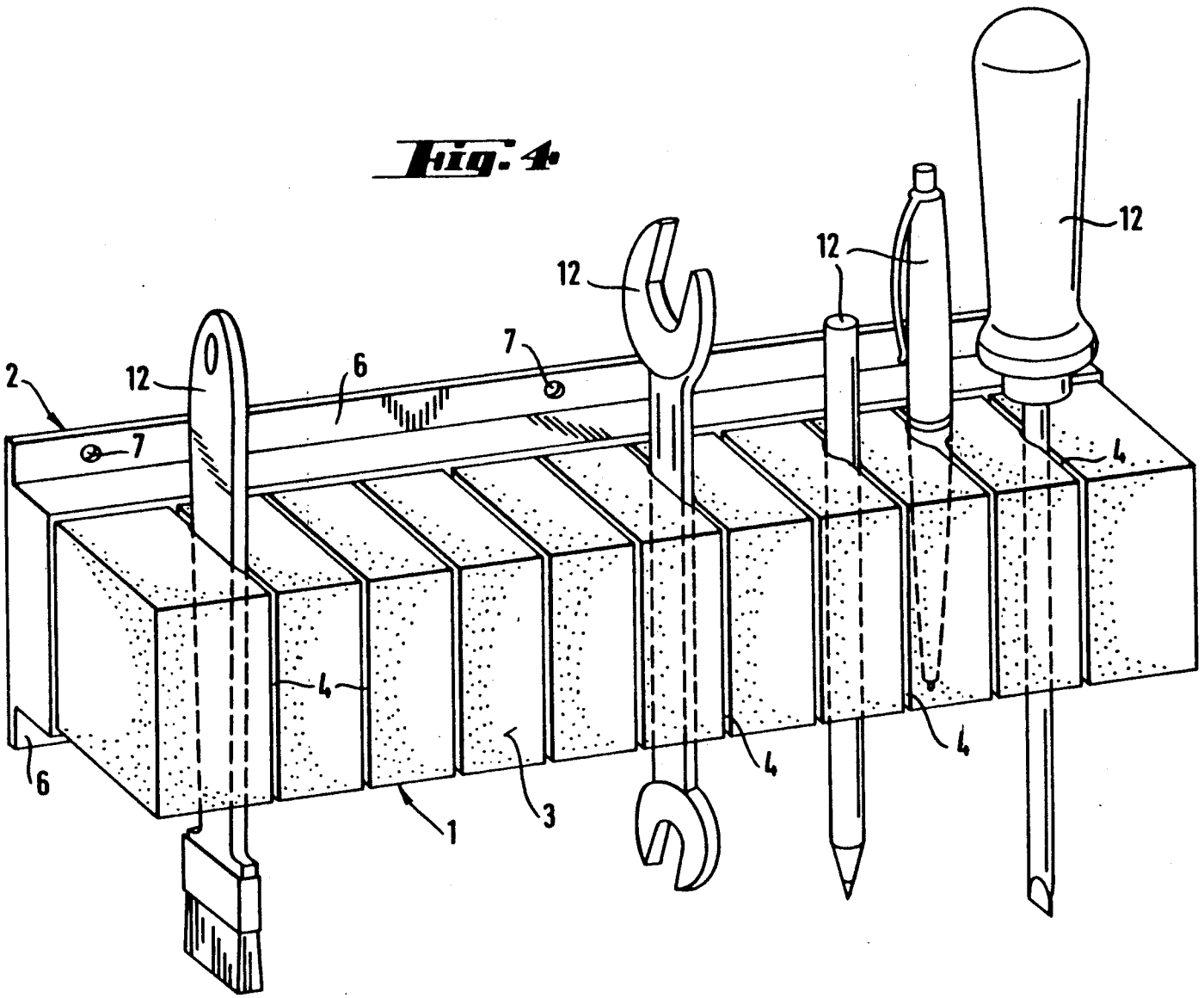
FIG. 4 a diagrammatic view of an embodiment with tools inserted therein

FIG. 4 shows the retaining device of FIG. 1 of the invention in diagrammatic form as a block 1 with incisions 4, a number of tools 12 of different types being inserted and held therein.

The alternative embodiment shown in FIG. 5 also consists of the foam block 1 and a frame 13 which surrounds the sides of the block 1 as well as its back. For this purpose the frame 13 has plates 14 arranged vertically to the back corresponding to the end faces of the block 1 which, in turn, are provided with extension pieces 15 arranged vertically thereto which extend onto a part of the front top and bottom of the block 1. In this embodiment the plates 14 more effectively prevent a sideways movement of the foam which is effected in the forms hitherto described by the larger dimension of the end pieces. Removal of the block towards the front is also not possible.

Unlike those previously described, the embodiment shown in FIG. 6 has a semi-circularly shaped foam block 16 in which the incisions 17 are made in a radial direction. This embodiment is merely an example of the way in which the device and, in particular, the foam block, may assume many different forms without departing from the underlying teaching of the invention. In this case, the block 16 may also be bonded to the frame 9 using an adhesive.

I claim:

1. A retaining device for generally vertically hanging a plurality of generally parallel disposed elongate objects, comprising:

(1) a generally longitudinally elongated, rectangular, parallelepiped, block of a resilient foamed plastic or rubber having front, back, top, bottom and side surfaces;

(2) a plurality of spaced-apart incisions disposed through said front surface and extending toward said back surface to at least beyond the longitudinal center of said block and terminating within said block such that the back surface thereof is continuous;

(3) a securing frame substantially surrounding at least a back portion of the said top, bottom and side surfaces and having a generally opened, rectangular, parallelepiped configuration; and (4) attachment means for mechanically attaching the said block to said frame, said attachment means having vertically disposed spaced-apart, connecting bars attached between longer sides of the frame which bars are spaced apart such that the bars are received into correspondingly spaced-apart incisions near the termination thereof.

2. A retaining device according to claim 1 wherein the frame has inwardly directed projections disposed along longer sides of the frame which projections project into the block and further retain the block by compression.

3. A retaining device according to claim 1 wherein the block comprises at least one polyurethane foam, PVC foam, polyethylene foam and foam rubber.

4. A retaining device according to claim 1 wherein the back surface of the block and/or a back surface of the securing frame is provided with a self-adhesive mounting surface.

* * * * *